US008806987B2

(12) United States Patent
Chen

(10) Patent No.: US 8,806,987 B2
(45) **Date of Patent: *Aug. 19, 2014**

(54) STEERING DEVICE FOR A RATCHET SCREWDRIVER

(76) Inventor: Yi-Fu Chen, Taichung (TW)

( * ) Notice: Subject to any disclaimer, the term of this patent is extended or adjusted under 35 U.S.C. 154(b) by 231 days.

This patent is subject to a terminal disclaimer.

(21) Appl. No.: 13/584,830

(22) Filed: Aug. 14, 2012

(65) Prior Publication Data

US 2012/0304831 A1 Dec. 6, 2012

Related U.S. Application Data

(63) Continuation-in-part of application No. 12/877,114, filed on Sep. 8, 2010, now Pat. No. 8,272,298.

(51) Int. Cl.
*B25B 13/46* (2006.01)
*B25B 15/04* (2006.01)

(52) U.S. Cl.
CPC ..... *B25B 15/04* (2013.01); *B25B 13/463* (2013.01)
USPC ..... 81/63.1

(58) Field of Classification Search
USPC ..... 81/60, 63.1, 438
See application file for complete search history.

(56) References Cited

U.S. PATENT DOCUMENTS

| | | | | | |
|---|---|---|---|---|---|
| 4,777,852 | A * | 10/1988 | Herman et al. | 81/63.1 |
| 5,437,212 | A * | 8/1995 | Thompson et al. | 81/63.1 |
| 5,570,616 | A * | 11/1996 | Thompson et al. | 81/63.1 |
| 5,687,820 | A * | 11/1997 | Lin | 192/43.2 |
| 5,974,915 | A * | 11/1999 | Chou | 81/63.1 |
| 6,047,617 | A * | 4/2000 | Chen | 81/63.1 |
| 6,053,077 | A * | 4/2000 | Huang | 81/63.1 |
| 6,148,696 | A * | 11/2000 | Chiang | 81/63.1 |
| 7,775,141 | B2 * | 8/2010 | Thompson et al. | 81/63.1 |
| 8,272,298 | B2 * | 9/2012 | Chen | 81/63.1 |
| 2006/0048610 | A1 * | 3/2006 | Hu | 81/60 |
| 2010/0024607 | A1 * | 2/2010 | Thompson et al. | 81/63.1 |
| 2010/0031783 | A1 * | 2/2010 | Hu | 81/63.1 |
| 2010/0229694 | A1 * | 9/2010 | Chen | 81/63.1 |

* cited by examiner

*Primary Examiner* — David B Thomas

(57) ABSTRACT

A steering device for a ratchet screwdriver includes a base. The base has a receiving hole defined therein. Two receiving grooves are defined in the base. A moving slot is comparted from receiving hole. A ratchet rod is partially received in the base. The ratchet rod includes a spindle and a ratchet wheel disposed on the spindle. Two blockers are respectively received in the two receiving grooves. Each blocker has unidirectional teeth formed on one end thereof for selectively engaging with the ratchet wheel. A housing is sleeved on the base. The housing has a protrusion disposed on an interior thereof for inserting into the moving slot.

6 Claims, 7 Drawing Sheets

STEERING DEVICE FOR A RATCHET SCREWDRIVER

CROSS-REFERENCE TO RELATED APPLICATION

This application is a Continuation-In-Part application of Ser. No. 12/877,114, filed 8 Nov. 2010, and entitled "STEERING DEVICE FOR A RATCHET SCREWDRIVER", now-pending.

BACKGROUND OF THE INVENTION

1. Field of the Invention

The present invention relates to a steering device, and more particularly to a steering device for a ratchet screwdriver.

2. Description of Related Art

A conventional ratchet screwdriver includes a body having a receiving hole defined therein and two receiving tanks radially defined therein. The receiving hole communicates with the receiving tanks. The two receiving tanks are formed with an angle relative to each other. Each receiving tank has two parallel sides formed thereon. A block sheet tank is defined in front of the receiving hole. A ratchet wheel has an annular teethed portion. The annular teethed portion is received in the receiving hole. Two teethed blocks are respectively received in the receiving tanks. Each teethed block has one end formed with teeth for engaging with the annular teethed portion, the other end formed with a block portion, and a sheet extending from a side thereof. Each block portion has an elastomer sleeving therewith and received in the receiving tank. A cover is sleeved on the body and has a through hole defined therein. The cover has a groove defined therein. A protrusion is formed on the groove. A block sheet is received in the block sheet tank. The ratchet wheel and two teethed block are restricted by the block sheet to prevent from detaching. When the ratchet screwdriver is operated, the cover is rotated, the protrusion is abutted against the sheet of the teethed block such that the teethed block is detached from the annular teethed portion. The ratchet driver is able to be clockwisely rotated for driving a workpiece and couter-clockwisely rotated for ratchetably skipping the teeth.

However, the sheet of the teethed block needs an extra process to be manufactured. The sheet has a thinner thickness and a smaller size such that the sheet has a week structure. The sheet is easily worn by the protrusion due to a long time using.

The present invention has arisen to obviate/mitigate the disadvantages of the conventional screwdriver.

SUMMARY OF THE INVENTION

The main objective of the present invention is to provide an improved steering device for a ratchet screwdriver.

To achieve the objective, a steering device for a ratchet screwdriver in accordance with the present invention comprises a base, a ratchet rod partially received in the base, and a housing sleeved on the base. The base is adapted to be mounted on a front end of the ratchet screwdriver. The base has a receiving hole defined therein. Two receiving grooves are defined in the base and respectively positioned two sides of the receiving hole for communicating with receiving hole. A moving slot is comparted from receiving hole and positioned between the two receiving grooves. The base has a base hole defined therein and positioned adjacent to the receiving hole. A positioning unit is received in the base hole. The positioning unit includes an elastomer received in the base hole and a ball mounted on the elastomer. The base has at least one rib extending from an outer periphery thereof. The ratchet rod includes a spindle and a ratchet wheel disposed on the spindle. The ratchet wheel has teeth annularly formed thereon. A distal end of the spindle has an inserting hole defined therein. The ratchet wheel is received in the receiving hole. Two blockers are respectively received in the two receiving grooves. Each blocker has unidirectional teeth formed on one end thereof for selectively engaging with the ratchet wheel and a stub extending from the other end thereof. A spring is sleeved on the stub of each blocker for abutting against an inner wall of the receiving groove. Each blocker has a sliding surface and a guiding surface respectively formed on two adjacent sides of the teeth thereof. The sliding surface is provided for abutting against an inner periphery of the receiving groove. The guiding surface is provided for abutting against the protrusion. The housing has a housing hole defined therein and passing therethrough for allowing the spindle passing through the housing. The housing has a protrusion disposed on an interior thereof for inserting into the moving slot. The interior of the housing has three positioning holes defined therein and corresponding to the base hole. The housing has at least one channel defined in an inner periphery thereof for corresponding to the at least one rib on the base. The at least one rib are restricted in the corresponding channel for restricting a rotation of the base relative to the housing.

In accordance with another aspect of the present invention, two receiving grooves are defined in the base and respectively positioned two sides of the receiving hole for communicating with receiving hole. One receiving groove has a blocking wall extending therefrom for dividing the receiving groove into a first groove and a third groove. The other receiving groove has a blocking wall extending therefrom for dividing the other receiving groove into a second groove and a fourth groove. Two moving slots are respectively comparted from receiving hole. One moving slot is positioned between the first and second grooves. The other moving slot positioned between the third and fourth grooves. Four blockers are respectively received in the first, second, third, and fourth grooves. The housing has two protrusions disposed on an interior thereof for respectively inserting into the two moving slots.

In accordance with another aspect of the present invention, a frame is mounted in the base and fitted with inner peripheries of the receiving hole, the receiving grooves and the moving slot. A metal material of the frame is different than that of the base. A hardness of the frame is greater than that of the base.

In accordance with another aspect of the present invention, the two blocking wall are formed with the frame.

The benefits of the present invention as the following:

1. The blocker is abutted by the protrusion on the housing, there is no necessary to have the sheet of the conventional teeth block and the extra process to manufacture the sheet.

2. A contact surface between the blocker and the protrusion is creased. The structure is enhanced for increasing a wear-resisting effort.

3. The sliding surface of the blocker is fitted with the inner periphery of the receiving groove. The movement of the blocker is smooth.

4. The hardness of the frame is grater than that of the base. Therefore, the structure of the base is enhanced to increase a wear-resisting effort.

Further benefits and advantages of the present invention will become apparent after a careful reading of the detailed description with appropriate reference to the accompanying drawings.

DETAILED DESCRIPTION OF TEE INVENTION

Figure 1:
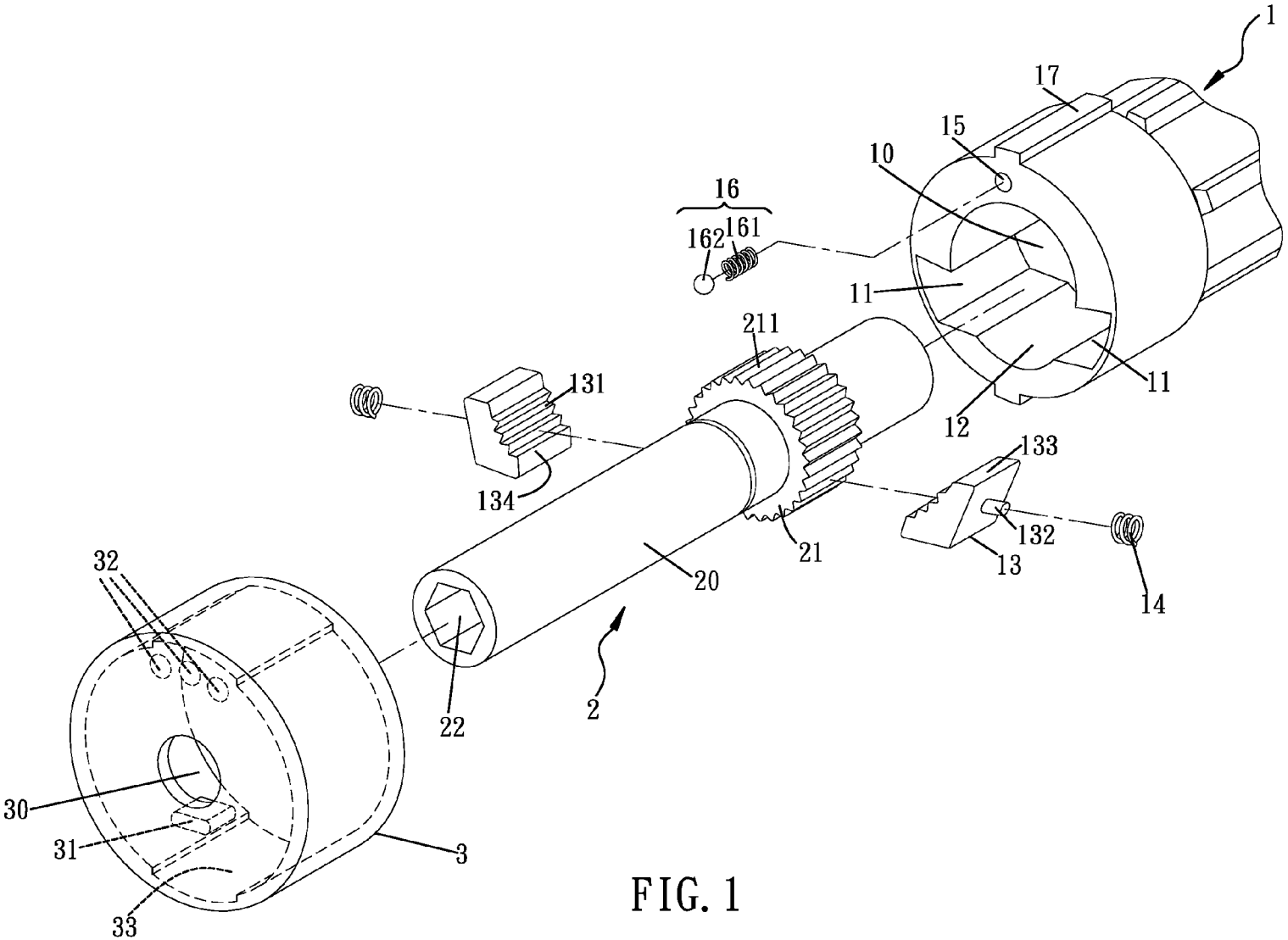
FIG. 1 is an exploded perspective view of a steering device for a ratchet screwdriver in accordance with the present invention.
Figure 2:
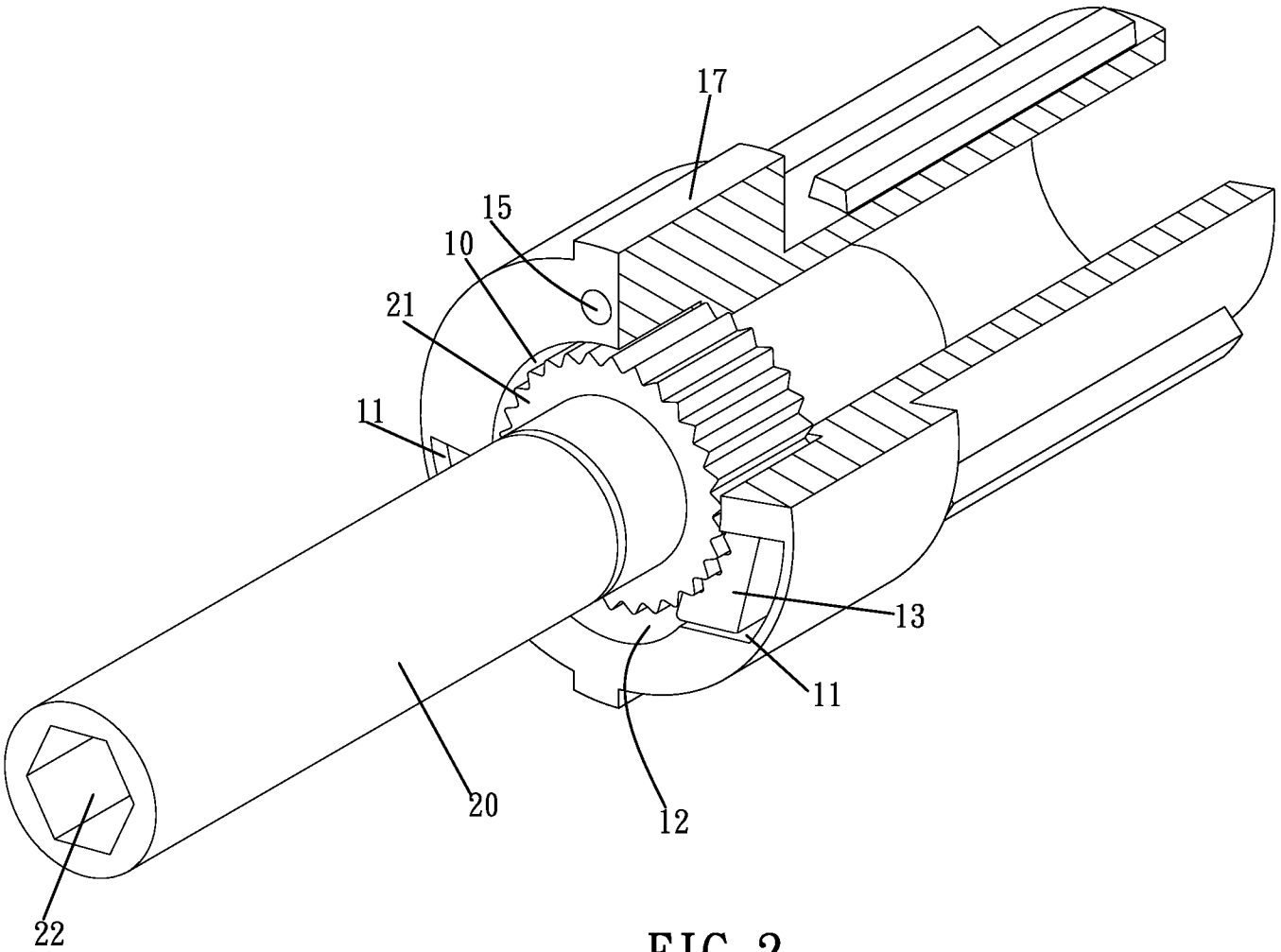
FIG. 2 is an assembled perspective view of the steering device for a ratchet screwdriver in accordance with the present invention.

Referring to the drawings and initially to FIGS. 1-4, the steering device for a ratchet screwdriver in accordance with the present invention comprises a base 1, a ratchet rod 2 partially received in the base 1, and a housing 3 sleeved on the base 1.

The base 1 is adapted to be mounted on a front end of the ratchet screwdriver (not shown). The base 1 has a receiving hole 10 defined therein. Two receiving grooves 11 are symmetrically defined in the base 1 and respectively positioned two sides of the receiving hole 10 for communicating with receiving hole 10. A moving slot 12 is comparted from receiving hole 10 and positioned between the two receiving grooves 11. The base 1 has a base hole 15 defined therein and positioned adjacent to the receiving hole 10. A positioning unit 16 is received in the base hole 15. The positioning unit 16 includes an elastomer 161 received in the base hole 15 and a ball 162 mounted on the elastomer 161. The base 1 has at least one rib 17 extending from an outer periphery thereof.

The ratchet rod 2 includes a spindle 20 and a ratchet wheel 21 disposed on the spindle 20. The ratchet wheel 21 has teeth 211 annularly formed thereon. A distal end of the spindle 20 has an inserting hole 22 defined therein for adapting to receive a tool bit (not shown). The ratchet wheel 21 is received in the receiving hole 10.

Two blockers 13 are respectively received in the two receiving grooves 11. Each blocker 13 has unidirectional teeth 131 formed on one end thereof for selectively engaging with the ratchet wheel 21 and a stub 132 extending from the other end thereof. A spring 14 is sleeved on the stub 132 of each blocker 13 for abutting against an inner wall of the receiving groove 11. Each blocker 13 has a sliding surface 133 and a guiding surface 134 respectively formed on two adjacent sides of the teeth 131 thereof. The sliding surface 133 is provided for abutting against an inner periphery of the receiving groove 11. The guiding surface 134 is provided for abutting against the protrusion 31.

Figure 4:
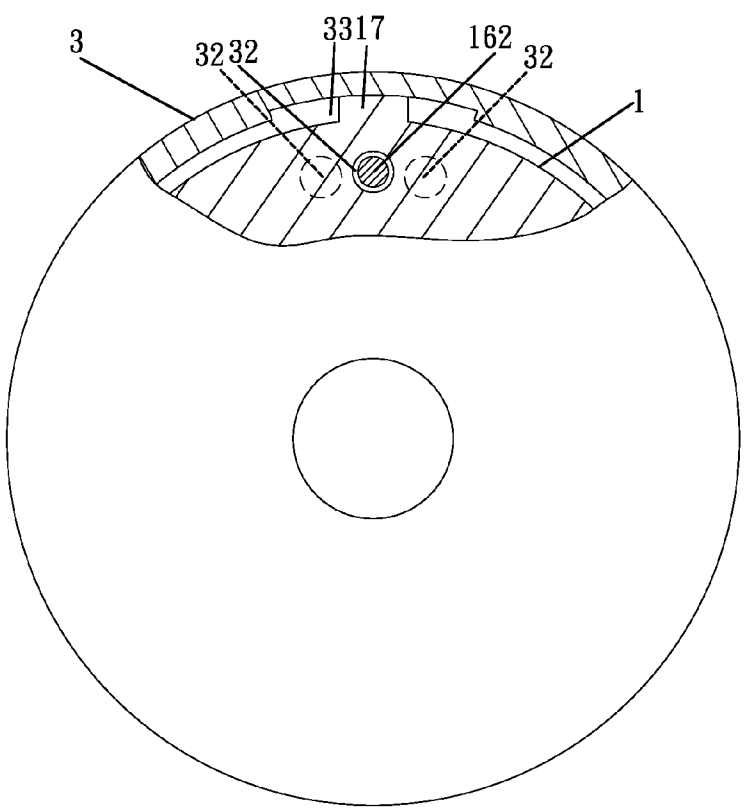
FIG. 4 is a cross-sectional view of the steering device in accordance with the present invention for showing the ball in the positioning hole.
Figure 3:
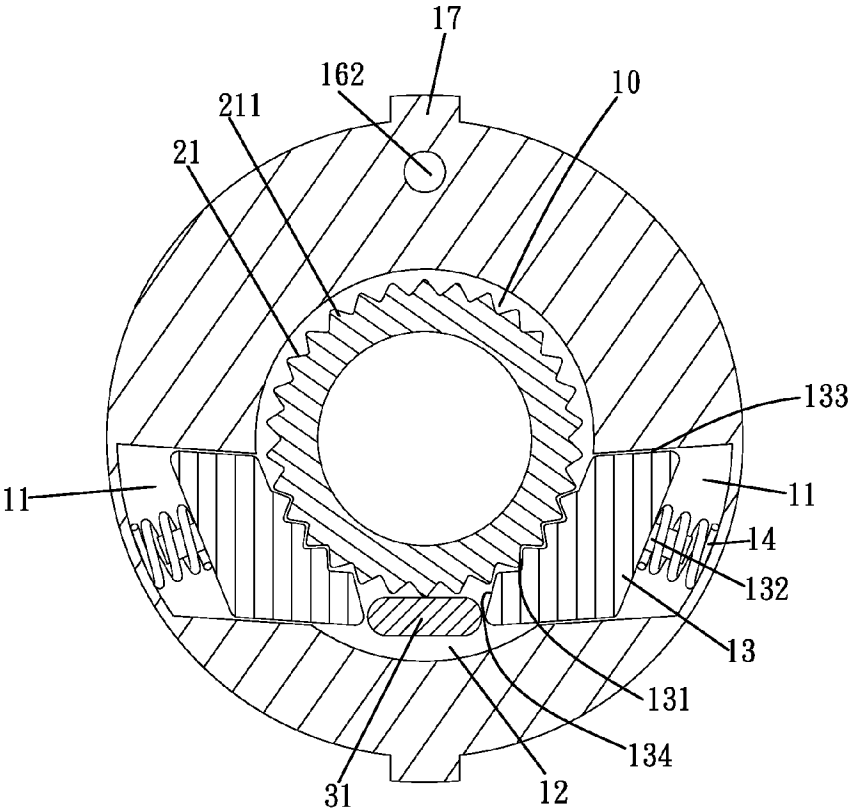
FIG. 3 is a cross-sectional view of the steering device in accordance with the present invention for showing the structure in the base.

The housing 3 has a housing hole 30 defined therein and passing therethrough for allowing the spindle 20 passing through the housing 3. The housing 3 has a protrusion 31 disposed on an interior thereof for inserting into the moving slot 12. The interior of the housing 3 has three positioning holes 32 defined therein and corresponding to the base hole 15. When the housing 3 is rotated relative to the base 1, the ball 162 is selectively and partially received in one of the three positioning holes 32. In the initial stage, as shown in FIG. 4, the ball 162 is partially received in a middle positioning hole 32.

The housing 3 has at least one channel 33 defined in an inner periphery thereof for corresponding to the at least one rib 17 on the base 1. A width of the channel 33 is equal to a spacing of the three positioning holes 32. The at least one rib 17 are restricted in the corresponding channel 33 for restricting a rotation of the base 1 relative to the housing 3. In the initial stage, each rib 17 is positioned in a middle of the corresponding channel 33.

Figure 6:
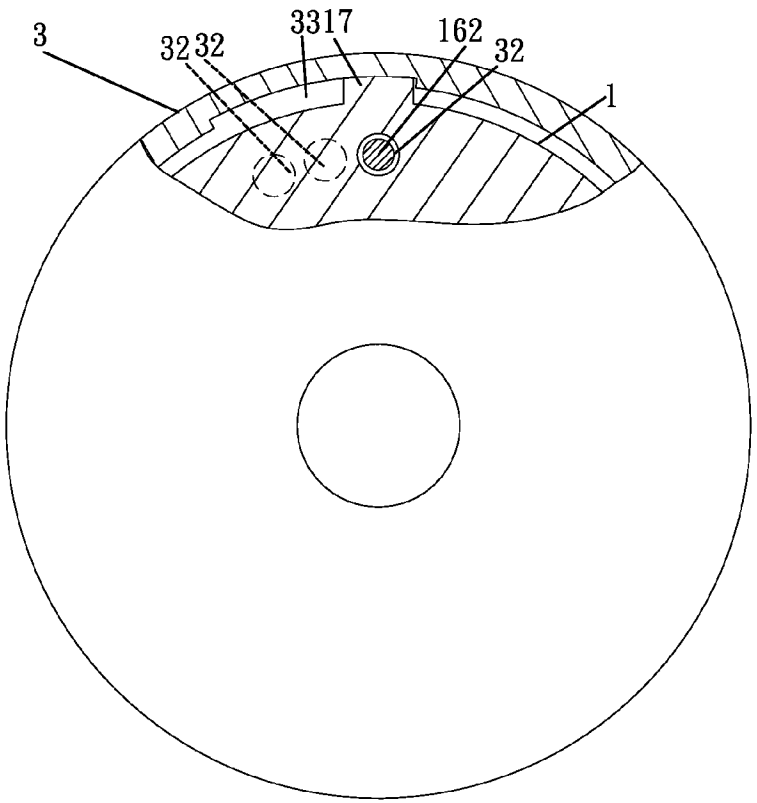
FIGS. 5-6 are operational cross-sectional views of the steering device for a ratchet screwdriver in accordance with the present invention.
Figure 5:
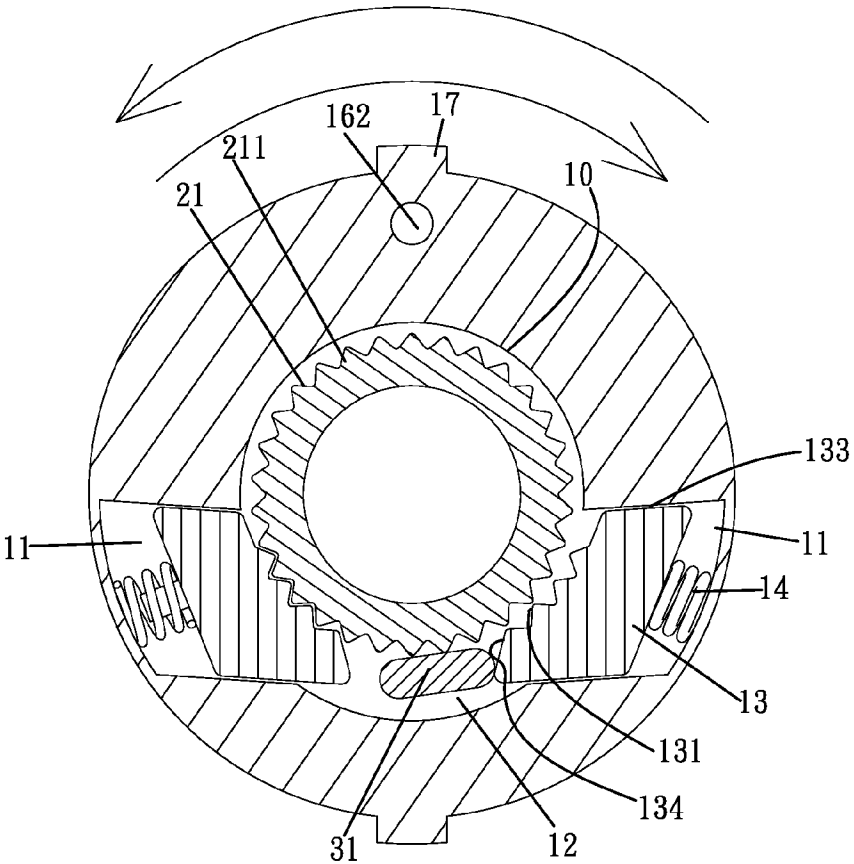

When the housing 3 is rotated relative to the base 1 for steering a operating direction of the ratchet screwdriver, the protrusion 31 is moved in the moving slot 12 and is abutted against either one of the two blockers 13 such that one blocker 13 is detached from the ratchet wheel 21 and the other blocker 13 is engaged with the ratchet wheel 21 for selectively steering a rotatable direction of the ratchet rod 2. As shown in FIGS. 5-6, when the housing 3 is counter-clockwisely rotated (as the outer arrow shown in FIG. 5), the protrusion 31 is abutted against the guiding surface 134 of the blacker 13 in the left side receiving groove 11 such that the blocker 13 is detached from the ratchet wheel 21. As shown in FIG. 6, the ball 162 is simultaneously received in the positioning hole 32 in the right side and the rib 17 is restricted by the right inner periphery of the channel 33 for preventing the housing 3 from over-rotating. The blocker 13 in the right side receiving grove is engaged with the ratchet wheel 21 such that the ratchet screwdriver is able to drive a workpiece (not shown) in clockwisely operation and ratchably rotate in counter-clockwisely operation.

Figure 7:
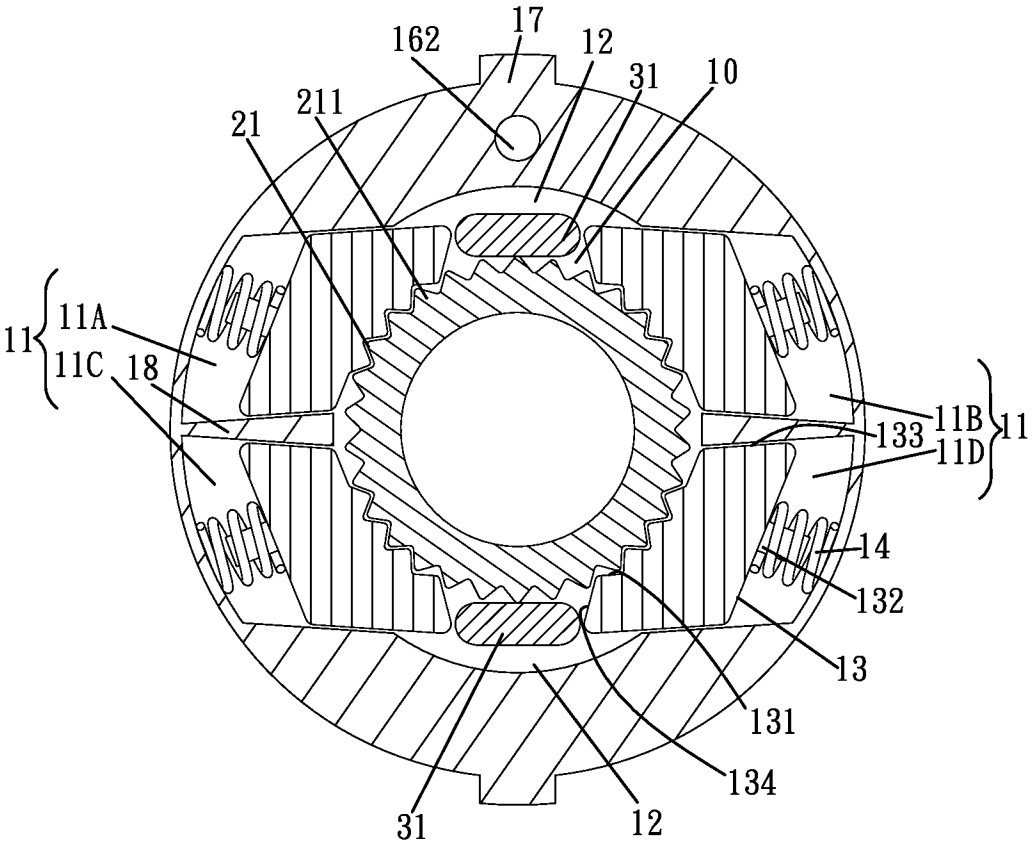
FIG. 7 is a cross-sectional view of a second embodiment of the steering device in accordance with the present invention for showing the structure in the base.

With reference to FIG. 7, that shows a second embodiment of the steering device for a ratchet screwdriver in accordance with the present invention. The elements and effects of the second embodiment which are the same with the first embodiment are not described, only the differences are described. Two receiving grooves 11 are defined in the base 1 and respectively positioned two sides of the receiving hole 10 for communicating with receiving hole 10. One receiving groove 11 (positioned in the left of FIG. 7) has a blocking wall 18 extending therefrom for dividing the receiving groove 11 into a first groove 11A and a third groove 11C. The other receiving groove 11 (positioned in the right of FIG. 7) has a blocking wall 18 extending therefrom for dividing the other receiving groove 11 into a second groove 11B and a fourth groove 11D. Two moving slots 12 are respectively comparted from receiving hole 10. One moving slot 12 (positioned in the top of the receiving hole of FIG. 7) is positioned between the first and second grooves 11A, 11B. The other moving slot 12 (positioned in the bottom of the receiving hole of FIG. 7) positioned between the third and fourth grooves 11C, 11D.

Four blockers 13 are respectively received in the first, second, third, and fourth grooves 11A, 11B, 11C, 11D. Each blocker 13 has unidirectional teeth 131 formed on one end thereof for selectively engaging with the ratchet wheel 21 and a spring 14 engaging with the other end thereof.

The housing 3 has two protrusions 31 disposed on an interior thereof for respectively inserting into the two moving slots 12.

Figure 9:
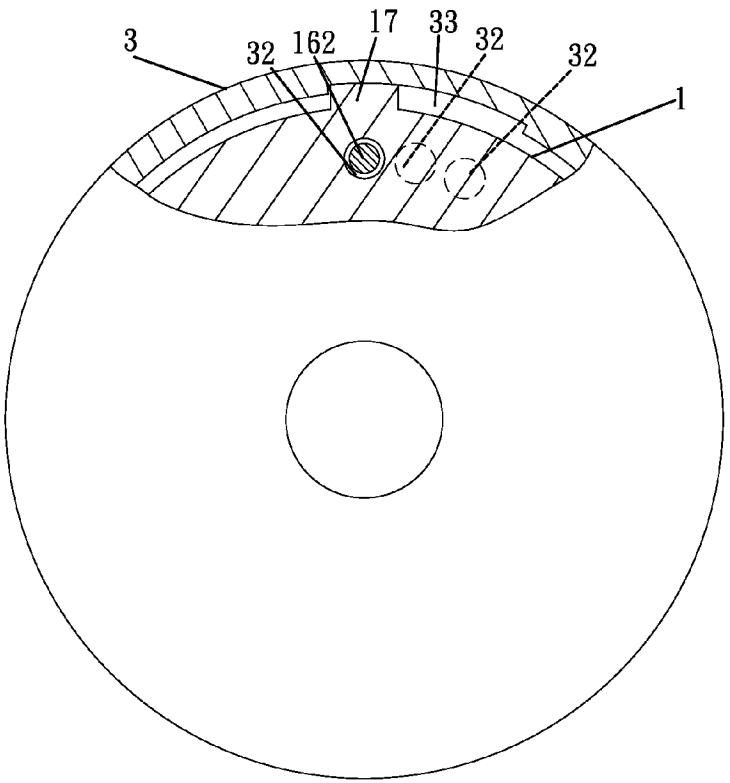
FIGS. 8-9 are operational cross-sectional views of the second embodiment of the steering device for a ratchet screwdriver in accordance with the present invention.
Figure 8:
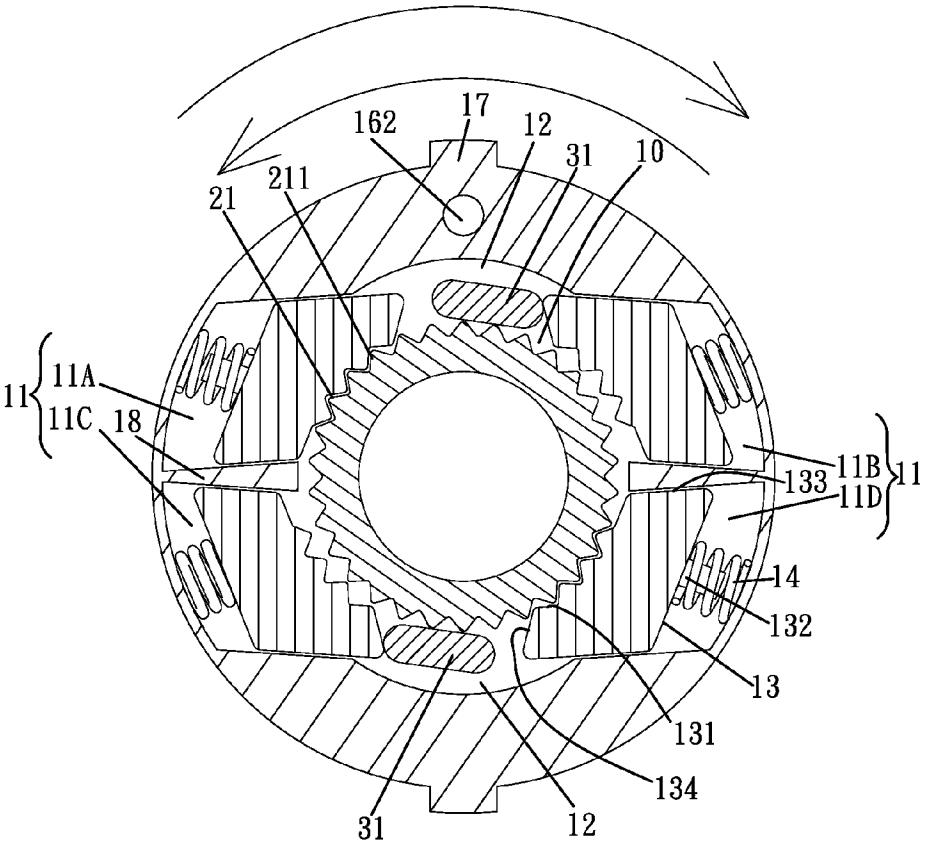

When the housing 3 is rotated relative to the base 1 for steering a operating direction of the ratchet screwdriver, the protrusions 31 are respectively moved in the moving slots 12 and are abutted against the two blockers 13 in the first/second groove 11A/11B and fourth/third groove 11D/11C to be detached from the ratchet wheel 21 such that and the other blockers 13 in the second/first groove 11B/11A and third/fourth groove 11C/11D are engaged with the ratchet wheel 21 for selectively steering a rotatable direction of the ratchet rod 2. As shown in FIGS. 8-9, when the housing 3 is clockwisly rotated relative to the base 1 (as the outer arrow shown in FIG. 8), the two protrusions 31 are respectively abutted against the two blockers 13 in the second and third grooves 11B, 11C such that the two blockers 13 in the second and third grooves 11B, 11C are detached from the ratchet wheel 21. As shown in FIG. 9, the ball 162 is simultaneously received in the positioning hole 32 in the left side and the rib 17 is restricted by the left inner periphery of the channel 33 for preventing the housing 3 from over-rotating. The two blockers 13 in the first and fourth groves 11A, 11D are engaged with the ratchet wheel 21 such that the ratchet screwdriver is able to drive the workpiece in counter-clockwisely operation and ratchably rotate in clockwisely operation.

Figure 10:
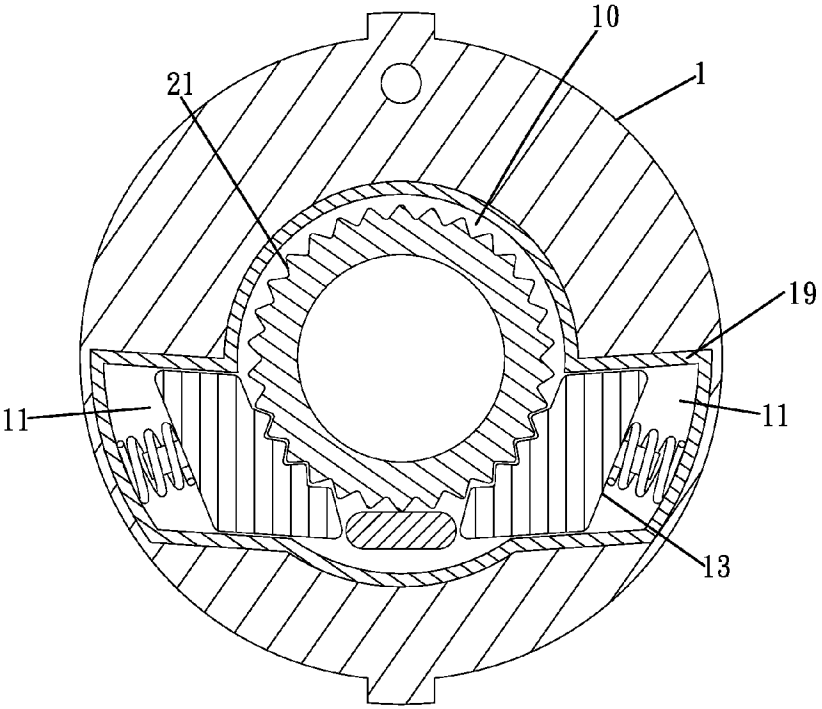
FIG. 10 is a cross-sectional view of a third embodiment of the steering device in accordance with the present invention for showing the frame in the base.

With reference to FIG. 10, that shows a third embodiment of the steering device for a ratchet screwdriver in accordance with the present invention. The elements and effects of the third embodiment which are the same with the first embodiment are not described, only the differences are described. A frame 19 is mounted in the base 1 and fitted with inner peripheries of the receiving hole 10, the receiving grooves 11 and the moving slot 12. A metal material of the frame 19 is different than that of the base 1. A hardness of the frame 19 is greater than that of the base 1. In the preferred embodiment of the present invention, the base 1 is made of zinc alloy and the frame 19 is made of steel such that the frame 19 has wear-resisting effort.

Figure 11:
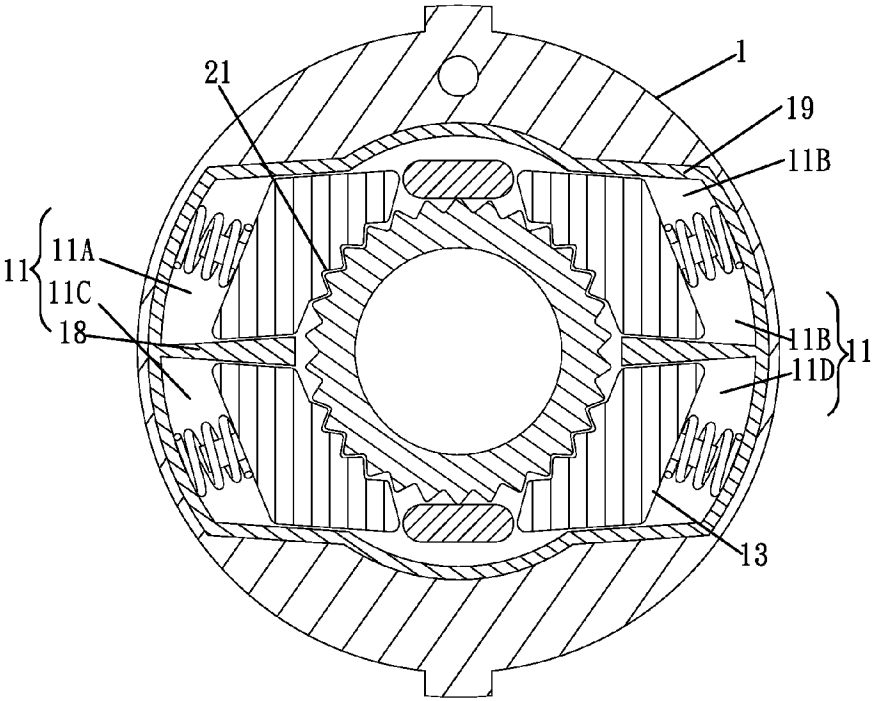
FIG. 11 is a cross-sectional view of a fourth embodiment of the steering device in accordance with the present invention for showing the frame in the base.

With reference to FIG. 11, that shows a fourth embodiment of the steering device for a ratchet screwdriver in accordance with the present invention. The elements and effects of the fourth embodiment which are the same with the second embodiment are not described, only the differences are described. A frame 19 is mounted in the base 1 and fitted with inner peripheries of the receiving hole 10, the receiving grooves 11, and the moving slots 12. The two blocking walls 18 are formed with the frame 19. A metal material of the frame 19 is different than that of the base 1. A hardness of the frame 19 is greater than that of the base 1. In the preferred embodiment of the present invention, the base 1 is made of zinc alloy and the frame 19 is made of steel such that the frame 19 has wear-resisting effort.

Although the invention has been explained in relations to its preferred embodiment, it is to be understood that many other possible modifications and variations can be made without departing from the spirit and scope of the invention as hereinafter claimed.

What is claimed is:

1. A steering device for a ratchet screwdriver comprising:

a base, the base adapted to be mounted on a front end of the ratchet screwdriver, the base having a receiving hole defined therein, two receiving grooves defined in the base and respectively positioned two sides of the receiving hole for communicating with receiving hole, a moving slot comparted from receiving hole and positioned between the two receiving grooves;

a ratchet rod partially received in the base, the ratchet rod including a spindle and a ratchet wheel disposed on the spindle, the ratchet wheel having teeth annularly formed thereon, a distal end of the spindle having an inserting hole defined therein for adapting to receive a tool bit, the ratchet wheel received in the receiving hole;

a housing sleeved on the base, the housing having a housing hole defined therein and passing therethrough for allowing the spindle passing through the housing, the housing having a protrusion disposed on an interior thereof for inserting into the moving slot, the housing having at least one channel defined in an inner periphery thereof, the base having at least one rib extending from an outer periphery thereof for corresponding to the at least one channel in the housing, the at least one rib restricted in the corresponding channel for restricting a rotation of the base relative to the housing; and two blockers respectively received in the two receiving grooves, each blocker having unidirectional teeth formed on one end thereof for selectively engaging with the ratchet wheel and a spring engaging with the other end thereof for abutting against an inner wall of the receiving groove, each blocker having a stub extending therefrom for connecting with the spring, each blocker having a sliding surface and a guiding surface respectively formed on two adjacent sides of the teeth thereof, the sliding surface provided for abutting against an inner periphery of the receiving groove, the guiding surface provided for abutting against the protrusion;

wherein when the housing is rotated relative to the base, the protrusion is moved in the moving slot and is abutted against either one of the two blockers such that one blocker is detached from the ratchet wheel and the other blocker is engaged with the ratchet wheel for selectively steering a rotatable direction of the ratchet rod.

2. The steering device for a ratchet screwdriver as claimed in claim 1, wherein the base has a base hole defined therein and positioned adjacent to the receiving hole, a positioning unit received in the base hole, the positioning unit including an elastomer received in the base hole and a ball mounted on the elastomer, the interior of the housing having three positioning holes defined therein and corresponding to the base hole; wherein when the housing is rotated relative to the base, the ball is selectively and partially received in one of the three positioning holes.

3. The steering device for a ratchet screwdriver as claimed in claim 1 furthering comprising a frame mounted in the base and fitted with inner peripheries of the receiving hole, the receiving grooves and the moving slot, a metal material of the frame being different from that of the base, a hardness of the frame being greater than that of the base.

4. A steering device for a ratchet screwdriver comprising:

a base, the base adapted to be mounted on a front end of the ratchet screwdriver, the base having a receiving hole defined therein, two receiving grooves defined in the base and respectively positioned two sides of the receiving hole for communicating with receiving hole, one receiving groove having a blocking wall extending therefrom for dividing the receiving groove into a first groove and a third groove, the other receiving groove having a blocking wall extending therefrom for dividing the other receiving groove into a second groove and a fourth groove;

two moving slots respectively comparted from receiving hole, one moving slot positioned between the first and second grooves, the other moving slot positioned between the third and fourth grooves;

a ratchet rod partially received in the base, the ratchet rod including a spindle and a ratchet wheel disposed on the spindle, the ratchet wheel having teeth annularly formed thereon, a distal end of the spindle having an inserting hole defined therein for adapting to receive a tool bit, the ratchet wheel received in the receiving hole;

a housing sleeved on the base, the housing having a housing hole defined therein and passing therethrough for allowing the spindle passing through the housing, the housing having two protrusions disposed on an interior thereof for respectively inserting into the two moving slots, the housing having at least one channel defined in an inner periphery thereof, the base having at least one rib extending from an outer periphery thereof for corresponding to the at least one channel in the housing, the at least one rib restricted in the corresponding channel for restricting a rotation of the base relative to the housing; and four blockers respectively received in the first, second, third, and fourth grooves, each blocker having unidirectional teeth formed on one end thereof for selectively engaging with the ratchet wheel and a spring engaging with the other end thereof, each blocker having a stub extending therefrom for connecting with the spring, each blocker having a sliding surface and a guiding surface respectively formed on two adjacent sides of the teeth thereof, the sliding surface provided for abutting against an inner periphery of the receiving groove, the guiding surface provided for abutting against the protrusion;

wherein when the housing is rotated relative to the base, the protrusions are respectively moved in the moving slots and are abutted against the two blockers in the first/second and fourth/third grooves to be detached from the ratchet wheel such that and the other blockers in the second/first and third/fourth grooves are engaged with the ratchet wheel for selectively steering a rotatable direction of the ratchet rod.

5. The steering device for a ratchet screwdriver as claimed in claim 4, wherein the base has a base hole defined therein and positioned adjacent to the receiving hole, a positioning unit received in the base hole, the positioning unit including an elastomer received in the base hole and a ball mounted on the elastomer, the interior of the housing having three positioning holes defined therein and corresponding to the base hole; wherein when the housing is rotated relative to the base, the ball is selectively and partially received in one of the three positioning holes.

6. The steering device for a ratchet screwdriver as claimed in claim 5 furthering comprising a frame mounted in the base and fitted with inner peripheries of the receiving hole, the receiving grooves, and the moving slots, a metal material of the frame being different from that of the base, a hardness of the frame being greater than that of the base.

* * * * *